US009770736B2

(12) United States Patent
Brugger

(10) Patent No.: US 9,770,736 B2
(45) Date of Patent: Sep. 26, 2017

(54) METERING DISPENSER FOR DISCHARGING AN IN PARTICULAR PASTY OR VISCOUS MATERIAL, SUCH AS COSMETIC CREAM, ADHESIVE, AND THE LIKE

(71) Applicant: Gerhard Brugger, Pflach (AT)

(72) Inventor: Gerhard Brugger, Pflach (AT)

( * ) Notice: Subject to any disclaimer, the term of this patent is extended or adjusted under 35 U.S.C. 154(b) by 0 days.

(21) Appl. No.: 14/899,824

(22) PCT Filed: May 23, 2014

(86) PCT No.: PCT/EP2014/001404

§ 371 (c)(1),
(2) Date: Dec. 18, 2015

(87) PCT Pub. No.: WO2015/003762

PCT Pub. Date: Jan. 15, 2015

(65) Prior Publication Data

US 2016/0144395 A1 May 26, 2016

(30) Foreign Application Priority Data

Jul. 9, 2013 (DE) ..... 20 2013 006 212 U

(51) Int. Cl.
*A45D 34/04* (2006.01)
*B05C 17/005* (2006.01)
(Continued)

(52) U.S. Cl.
CPC ..... *B05C 17/00569* (2013.01); *A45D 40/262* (2013.01); *A46B 9/021* (2013.01);
(Continued)

(58) Field of Classification Search
CPC ..... A45D 34/04
(Continued)

(56) References Cited

U.S. PATENT DOCUMENTS 8,308,386 B2 * 11/2012 Ki ..... A45D 34/042 401/176
2009/0311036 A1 * 12/2009 Pires ..... A45D 34/04 401/263
2011/0170934 A1 * 7/2011 Ki ..... A45D 34/04 401/118

FOREIGN PATENT DOCUMENTS

EP 2332442 A1 6/2011

OTHER PUBLICATIONS

International Search Report prepared by the European Patent Office on Aug. 6, 2014, for International Application No. PCT/EP2014/001404.

* cited by examiner

*Primary Examiner* — Jennifer C Chiang
*Assistant Examiner* — Joshua Wiljanen
(74) *Attorney, Agent, or Firm* — Lewis Brisbois Bisgaard & Smith LLP

(57) ABSTRACT

A dosing dispenser for dispensing a material comprising a housing, a container moveably arranged in the housing and including the material, a pump unit, and an applicator for material output. The housing includes an actuation member which facilitates moving the container in the housing relative to the pump unit, so that the pump unit is activatable by the container for suctioning and dispensing the material. The actuation member is formed by an opening in the housing for manual access to the container in order to move the container in a linear manner. Alternatively, the actuation member is configured as a slider element which is inserted into an opening of the housing and coupled with the container, wherein the slider element is translatorically moveable in the opening so that the container is moveable back and forth by the sliding movement of the slider element in order to activate the pump unit.

13 Claims, 7 Drawing Sheets

(51) Int. Cl.

| | |
|---|---|
| ***A45D 40/26*** | (2006.01) |
| ***A46B 9/02*** | (2006.01) |
| ***A46B 11/00*** | (2006.01) |
| *B05B 11/00* | (2006.01) |

(52) U.S. Cl.
CPC ..... *A46B 11/002* (2013.01); *A46B 11/0058* (2013.01); *B05B 11/0035* (2013.01); *B05B 11/0054* (2013.01); *B05B 11/3004* (2013.01); *B05B 11/3008* (2013.01); *B05B 11/3015* (2013.01); *B05B 11/3059* (2013.01); *B05C 17/00576* (2013.01); *A45D 34/04* (2013.01); *A45D 2200/055* (2013.01); *B05B 11/0032* (2013.01); *B05B 11/0037* (2013.01); *B05B 11/0048* (2013.01); *B05B 11/0064* (2013.01); *B05B 11/3052* (2013.01); *B05B 11/3074* (2013.01)

(58) Field of Classification Search
USPC ..... 401/188 R; 222/389
See application file for complete search history.

A-A

B-B

A-A

B-B

C-C

METERING DISPENSER FOR DISCHARGING AN IN PARTICULAR PASTY OR VISCOUS MATERIAL, SUCH AS COSMETIC CREAM, ADHESIVE, AND THE LIKE

CROSS REFERENCE TO RELATED APPLICATIONS

This application is a national stage application under 35 U.S.C. 371 and claims the benefit of PCT Application No. PCT/EP2014/001404 having an international filing date of May 23, 2014, which designated the United States, which PCT application claimed the benefit of German Patent Application No. 20 2013 006 212.6 filed Jul. 9, 2013, the disclosures of each of which are incorporated herein by reference.

FIELD OF THE INVENTION

The invention relates to a dosing dispenser according to the preamble of claim 1. The invention relates in particular to a one component dosing dispenser configured to put out a material, or a component, in particular through an applicator arranged at the dosing dispenser.

BACKGROUND

Dosing dispensers of this type have been commercially available in different embodiments for years and are used in particular for cosmetics in order to put out creams, gels and similar in doses. The dosing dispensers are used more and more for other applications, in particular the technical field like e.g. for glues and similar. This is a typical mass market product which emphases in particular simple configuration and ease of manufacture and which on the other hand side has to provide a good optical design, in particular in the main application in the field of cosmetics. As evident from the pertinent prior art it is difficult to comply with all these requirements in combination.

Known dosing dispensers typically include a dosing dispenser housing with a cartridge firmly arranged therein for receiving the material or the component to be put out, an upstream pump unit and, optionally, an applicator. The output is typically performed by an actuation member thus a laterally arranged push button or an adjustment button arranged at the base wherein an actuation of the adjustment button rotates a push drive arranged in the dispenser housing in particular a threaded rod which then successively moves a piston forward that is arranged at a lower end of the cartridge due to a translatoric movement so that the material can be put out from the cartridge. It is apparent that this requires mechanical complexity which is detrimental for a mass market product. It is a particular disadvantage of these dosing dispensers that handling is not optimum because typically dosing is performed by manual actuation of the push button or the turning knob but then re gripping the dosing dispenser in the hand is required in order to apply the amount of material to be put out onto the surface to be treated. Also this is complicated and detrimental.

Known dosing dispensers (such as DE 20 2010 009 751 U1 and DE 20 2010 011 248 U1) which are characterized by a compact and slender, in particular pin shaped construction, have proven themselves in practical applications and upon which the invention improves. The dosing dispensers are also used for two components dosing dispensers in which two respective cartridges are inserted into a dispenser housing and in which a dosed output of the materials received in the cartridge in the predetermined or adjustable mixing ratios can be provided by an adjustment device that is arranged at a base below the cartridges. These known cartridges are characterized by a conveniently configured pump unit with a pump cylinder and a pump piston interacting therewith between which a compression spring is arranged actuation or output of the components is performed in that the piston of the pump unit that is arranged upstream of the cartridge is actuated.

Finally, dosing dispensers are known (such as DE 100 32976 A1, in particular FIG. 4a included therein) in which a separate container is suspended within a dispenser housing, thus at a pump unit that is used for dispensing the material. Thus the dispensing is performed in that the container is moved in a direction towards the pump unit. This is performed by a lever mechanism with a pivotably supported lever. Thus the linkage mechanism includes a linkage bolt that is supported at the dispenser housing at which the pivot lever is supported. The inner end of the lever that protrudes beyond the linkage bolt is coupled with the pump unit so that the container is pressed upward after actuating the pivot lever and the material is put out. This actuation mechanism is complex and also failure prone after frequent use. In particular a comparatively wide configuration of the dosing dispenser is caused by this linkage mechanism in the portion of the pump unit so that a slender compact configuration cannot be provided. Practical applications also show that due to the pivot movement no fine adjusted output of material is possible, rather typically an output is provided according to the complete pivot process.

A comparable configuration of a dosing dispenser can be derived from US 2007/01 25799 A1 which also requires an actuation mechanism with complex configuration in order to move the material container that is separately received in the dispenser housing wherein the movement is provided relative to the pump unit for putting out the material. This configuration requires a plurality of separated components so that this yields a complex and wide configuration. Besides the error failure propensity of such arrangements in practical applications the plurality of components used also yields complex assembly so that dosing dispensers of this type have not really proven suitable for mass production.

SUMMARY OF THE INVENTION

Thus it is an object of the invention to provide a dosing dispenser, in particular for a dosed dispensing of only one component or a material, which is characterized by a simple configuration, ease of fabrication and simple handling. In particular the dosing dispenser of this type shall provide that the components required for actuating the dosing dispenser facilitate a configuration of the dispenser that is as compact as possible, in particular so that the actuation member can be integrated essentially flush into the dispenser housing.

This object is achieved according to the invention by the features included in the characterizing portion of claim 1 wherein advantageously embodiments of the invention are characterized by the features included in the independent claims.

According to the invention the dosing dispenser is characterized in that a container including the component to be put out or the material to be put out is supported moveable in a linear manner within the dispenser housing, in particular moveable in a translatoric manner in a direction of the longitudinal axis of the dispenser housing and moveable accordingly by an actuation member in order to thus activate the pump unit. This means the actuation stroke of the container determines the actuation of the pump unit for a purpose of dosed material dispensing.

Any pump unit can thus be used for a pump unit, pump units are particularly suitable as described in DE 20 2010 011 248 U1 or DE 20 2010 009 751 U1. According to the invention the stroke of the container when actuating the actuation member moves the pump cylinder of the pump unit in a direction towards the pump piston which has the consequence that the pump cavity is reduced in size by the penetrating pump piston.

In case material from the container was already dosed in the pump cavity due to the pressure from the incoming piston the material is put out from the pump unit in a pass through opening that is provided in the pump piston, thus advantageously in an outward direction by a pre-arranged applicator. Any customary and suitable embodiment can be used for the applicator as they are typically used for the dosing dispenser.

In a particularly simple manner the actuation of the container for activating the pump unit can be performed for the output of the material by a direct manual access to the container which can be moved up and down manually through the finger pressure. Thus it is advantageous to provide an opening for manual access in the dispenser housing. In this context it is advantageous to provide a friction enhancing configuration in the portion of the container which is aligned with the opening, like e.g. a ribbing, roughening, knobs or rubber application in order to facilitate ease of movement for the container for activating the pump.

Alternatively, however, a mechanical actuation member can also be used for moving the container within the dispenser housing. For this purpose a slider element is particularly suitable that is received in an opening of the dispenser housing wherein the slider element is advantageously manually moveable in a translatoric manner parallel to the longitudinal axis of the dosing dispenser housing. The slider element is thus coupled with the container so that the container is moveable in forward direction towards the pump unit for activating the container by moving the slider element forward or moving it in a linear manner.

In both cases it is possible to arrange the actuation member in the dispenser housing so that it is either recessed inward relative to an outer jacket of the dosing dispenser or advantageously flush with the outer jacket of the dosing dispenser housing so a compact and optically appealing configuration is provided. This has the advantage that the dosing dispenser is configured exceptionally slim and can thus also be offered in a slim packaging and furthermore unintentional dispensing when handling the dosing dispenser can be typically avoided. Furthermore this configuration also has optical advantages which is very important for a mass market product of this type, in particular when used in a cosmetics application because this does not interfere with the slender configuration of the dispenser housing. Thus the configuration according to the invention is suitable for dosing dispensers with a cylindrical cross section but also for any other cross section, thus a rectangular cross section or a triangular cross section. With respect to the slider element it is within the scope of the invention to have the slider element protrude by a small amount in outward direction, this means with respect to the dispenser housing which facilitates gripping the slider. This is in the millimeter range, thus approximately 6 or 7 mm, in particular not more than 3-4 mm.

In particular it is furthermore advantageous for handling to arrange the actuation member in a forward third of the dispenser housing if possible, thus also the opening for receiving the actuation member and its movement in particular as close as possible to the pump unit or in a portion which is arranged in particular directly outside of the pump unit. In an arrangement of this type a dosing can be performed in which no re gripping of the dosing dispenser for applying the dispensed material to the operating surface, thus skin or a gluing surface.

In case of a slider element it is useful when the sliding element is configured with a sleeve element which is advantageously integrally formed at the slider element and at least partially envelops the container. This facilitates a simple coupling of the slider element to the container. In this context it is advantageous in particular when the sleeve element is formed by an annular sleeve which envelops a portion of the container, in particular a sleeve extending the container.

In case of a slider element it is furthermore advantageous to provide the slider element with a handle recess for easer handling. In this context it is furthermore advantageous that another handle cut out is provided at the dispenser housing opposite to the grip reset in order to be able to grip the dosing dispenser for dosing. The additional handle cut out is advantageously slightly higher or wider in a direction towards the applicator that is applied in front than the other handle recess.

Activating the pump unit is advantageously performed by a face wall closing the container wherein the face wall is provided with a dispensing opening and moves the pump cylinder along due to the movement of the container, thus so that the pump cylinder is moved over the piston wherein the piston thus penetrates the pump cavity formed by the pump cylinder which puts out material that is disposed in the pump cavity. When running back the pump piston which can be performed self-acting after disengaging the actuation member due to a spring provided between the pump cylinder and the pump piston the pump cylinder is moved again relative to the pump piston in particular moved backward so that the piston moves from the pump cylinder back into its starting position which generates a vacuum in the pump cavity which in turn feeds material or the component out of the container into the pump cavity.

Thus it is advantageous when a seal jacket is arranged between the pump cylinder and the face wall of the container wherein the seal jacket is advantageously made from a flexible material, in particular from a rubber material and includes a closing opening which opens when a vacuum is generated in the pump cavity thus through a lifting of the jacket portion adjacent to the slot in upward direction towards the pump cavity so that a respective output of the material from the container is possible then.

Certainly pump units with other configurations that can be used for dosing dispensers of this type are also suitable, in particular the pump unit previously described can also be installed in another direction so that the pump piston is moved through the face wall or a component arranged at the container and then penetrates the pump cylinder arranged in front.

For such pump units it is advantageous to provide a valve element for the pump piston or a valve element for an inverse construction for the pump cylinder. In case of the valve member for the pump piston the valve member closes the pass through provided in the pump piston, thus due to a preload spring, wherein the valve element can be opened by building up pressure within the pump cavity so that the material can be put out in a direction towards an applicator that is applied in front. Advantageously the end of the container that is opposite to the pump unit is closed by a piston which can be inserted after filling the container with the material or the component into the container end and then moves forward towards the pump unit during the dosing due to the adherence to the material and due to the vacuum during putting out the material from the container wherein the piston after complete emptying of the container eventually contacts the face wall of the container.

When required it can be advantageous to provide a cover at an end of the container which is arranged opposite to the pump unit. A cover of this type however can also be configured as a push button which is in particular spring preloaded. A respective actuation of the push button can also initiate a movement of the container wherein the push button is advantageously coupled with the container. This configuration can be used as an alternative to the actuation member provided in an upper third of the dispenser housing, in particular however in addition to the actuation member so that two handling options are provided.

For ease of manufacture it is advantageous when individual components which have to be fixated at each other are interlocked with each other by an interlocking or clip connection.

Advantageously the components or at least a majority of the components besides the springs are made from plastic material, thus from a thermal plastic material so that injection molding the components is easily provided. Advantageously the springs provided in the dosing dispenser can also be made from plastic material.

BRIEF DESCRIPTION OF DRAWINGS

Subsequently advantageous embodiments of the invention are described, wherein.

DETAILED DESCRIPTION

FIGS. 1-4 illustrate a one component dosing dispenser for dispensing a material, in particular a pasty or viscous material, thus various materials can be used depending on the application, wherein cosmetics are a main application, the dispenser however is also useable for other applications like glues, gels, liquids or similar of various types.

Figure 1:
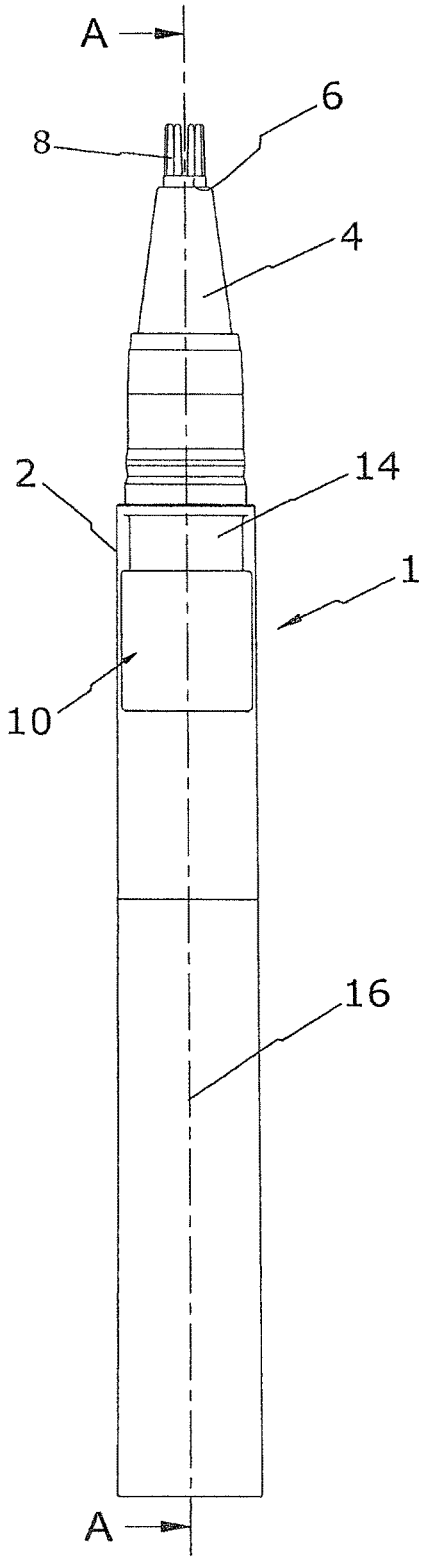
FIG. 1 illustrates an outside view of an embodiment of a dosing dispenser according to the invention.
Figure 2:
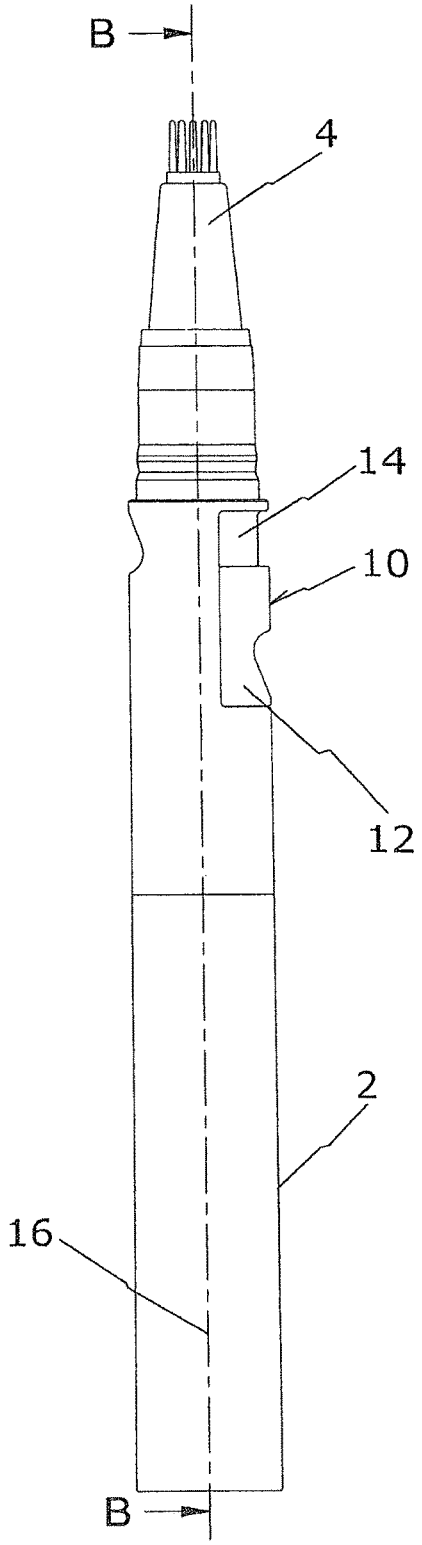
FIG. 2 illustrates a representation of the dosing dispenser illustrated in FIG. 1 that is rotated by 90°.

According to FIGS. 1 and 2 which illustrate exterior views of the dosing dispenser that are rotated by 90°. The dosing dispenser that is in general designated with one and in particular pin shaped includes a housing 2 with an applicator 4 applied thereto in particular through an insertion and/or interlocking closure of clip closure which is of conventional construction and has a brush shaped structure 8 that is applied to the outlet opening 6 of the applicator in the illustrated embodiment, wherein the brush shaped structure is only an exemplary illustrative embodiment. Instead of a brush shaped structure as illustrated in FIGS. 1-4 a nozzle piece can also be used instead, wherein the nozzle piece has a beveled outlet opening. Additionally any suitable applicator can be used.

Optionally and thus not necessarily, but advantageously the slender and compact dosing dispenser 1 illustrated in FIGS. 1-4 includes an actuation member 10 which is configured herein as a slider element 12 or a slider 12. The slider 12 is advantageously configured so that it cannot be lost as will be subsequently described based on FIGS. 8-10 wherein the slider 12 is received in an elongated opening 14 of the dispenser housing 1.

Advantageously the actuation member 10 is arranged in an upper third of the dispenser housing 1, thus advantageously as close as possible to the applicator 4 applied on top and in the instant embodiment directly below the pump described infra. Through the actuation member that is moveable in a linear manner along the housing access dosing of the material from the dosing dispenser can be performed through the outlet opening 6. Due to the arrangement of the upper actuation member 10 in the upper portion of the dispenser housing 1 the material is manually put out with simple handling without requiring moving the dosing dispenser in the hand in order to apply the material onto the operating surface in case of glue or onto the skin in case of cosmetics. Due to this configuration the dosing dispenser can be operated with one hand alone through a simple linear movement which represents a substantial advantage over conventional dosing dispensers and as will be described infra in more detail with a very simple configuration of the dosing dispenser. This has substantial advantages for a mass market product.

As evident from FIGS. 1 and 2 the opening 14 extends parallel to a longitudinal axis 16 of the dosing dispenser. The longitudinal extension of the opening 14 is longer in the illustrated embodiment than the longitudinal extension of the slider received in the opening 14 so that the slider can be moved by finger pressure in a translatoric manner in the opening 14 sufficiently for a dosing stroke in upward direction and in downward direction parallel to the longitudinal axis 16 of the dosing dispenser 20 as will be stated in more detail infra.

Thus it can be advantageous to configure the actuation member 10 or the slider element 12 with a handle recess 18 in order to be able to grip the slider element 12 better with one finger for a translatoric movement thus applying corresponding pressure. Thus it is furthermore advantageous when an additional grip opening 20 is provided on the opposite side, thus moved slightly upward relative to the handle recess 18 arranged opposite in the dispenser housing 2 which is not mandatory but advantageous.

The handle recesses are used for facilitating handling. Suitable measures instead of the handle recesses would be for example roughening the outer surface of the slider element and optionally at an opposite portion of the dispenser housing, a rubber coating, a rib formation, and similar. This means additional suitable measures can be performed in order to facilitate handling the slider element 12.

Figure 3:
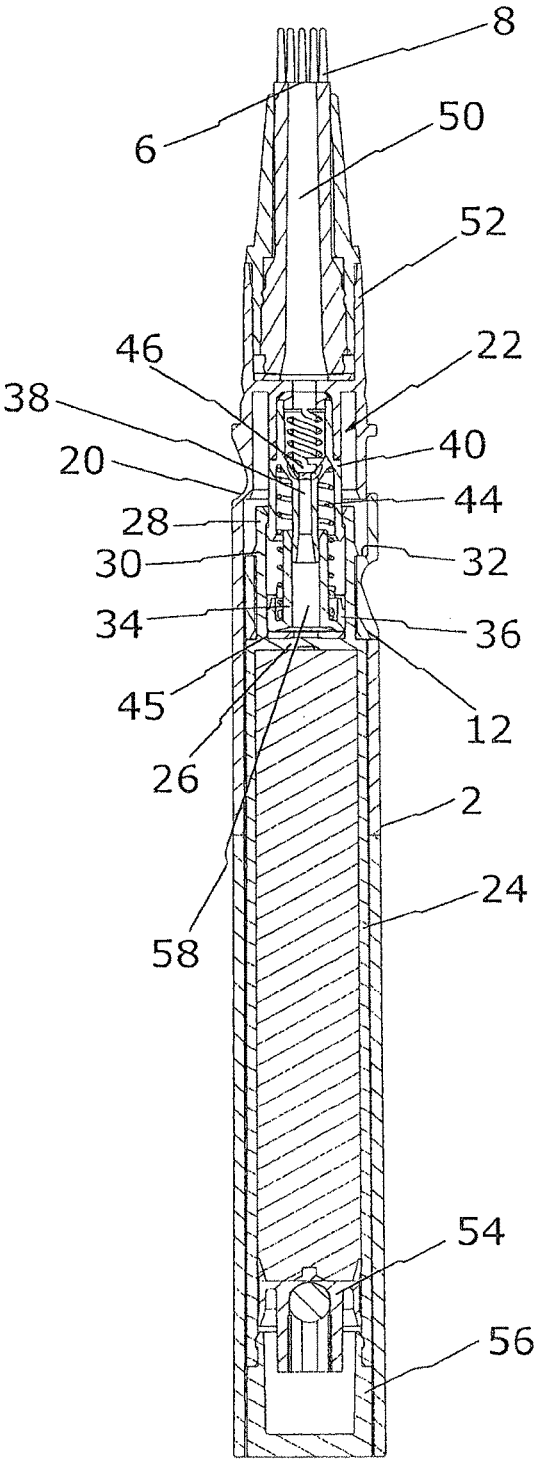
FIG. 3 illustrates a sectional view of the dosing dispenser according to FIG. 1 cut along the plane A-A, thus in a 2:1 scale.
Figure 4:
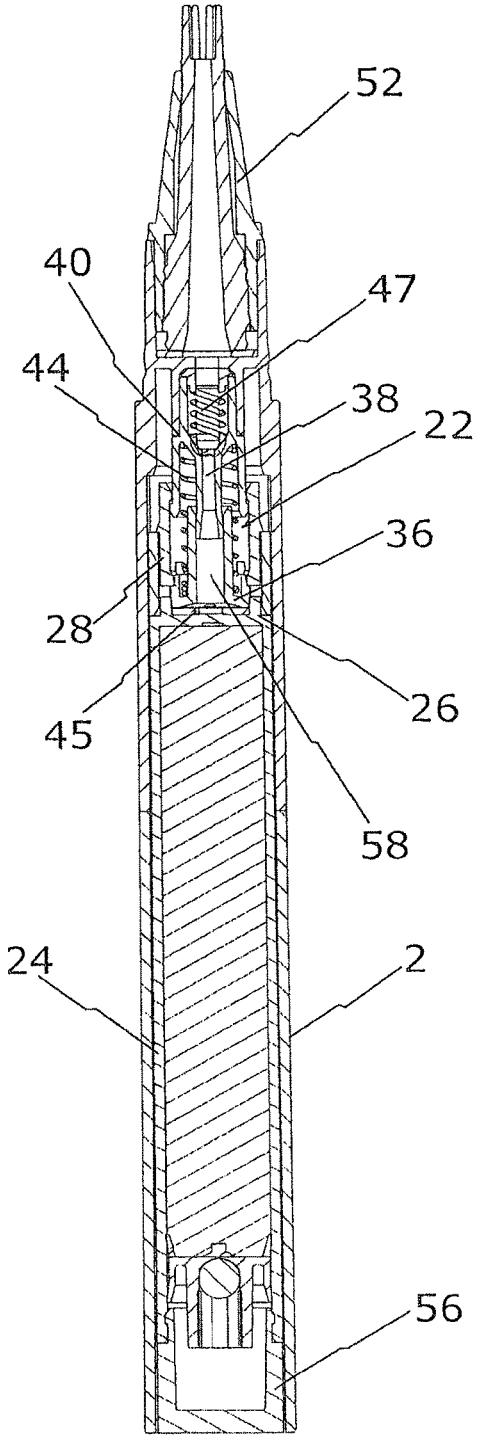
FIG. 4 illustrates a sectional view of the dosing dispenser along the line B-B of FIG. 2.

FIGS. 3 and 4 which illustrate two sectional views of the dosing dispenser according to FIGS. 1 and 2 rotated by 90° yield an inner configuration of the dosing dispenser. Thus it is appreciated that the structural features and the functional measures described in conjunction with the configuration and design of the dosing dispenser have to be viewed in a combinatoric context but protection is applied for each structural feature and functional measure individually and thus independently from the additional subsequently described features and measures, this means the described individual features have to be viewed by themselves when they are subsequently stated for the purposes of describing the invention in combination with other features, thus even when this is not explicitly stated infra.

As a matter of principle the dosing dispenser includes the described rotation cylindrical and elongated housing configured as a pen and the applicator 4 and the pump unit 22 which is arranged in the illustrated embodiment advantageously with a container 24 arranged in the housing 2 which is configured as a cartridge and an applicator 4. In the container 24 there is the material that shall be put out by the dosing dispenser or the component wherein this is in particular a material or a component that is pasty or viscous like for example cosmetics, gels or glues or a liquid. In the illustrated embodiment the container 24 is open at the bottom thus at an end that is opposite to the applicator 4 and can be filled from there with the component to be put out. Advantageously the housing 2 represents a support sleeve for the container 24 which corresponds to an inner contour of the housing and which has a circular cylindrical cross section in this embodiment which however is not mandatory. At the upper end the container 24 is closed by a face wall 26 which is provided with one or plural openings that are not illustrated for flowing the component over from the container 24 in a direction towards the pump. Starting from the face wall 26 of the container 24 a sleeve 28 extends in upward direction which is advantageously made in one piece together with the container 24 in particular by injection molding.

As evident from FIGS. 3 and 4 an outward protruding shoulder 30 that is in particular hook shaped is provided at the container sleeve 28. The shoulder 30 is advantageously configured as an annular shoulder 30 in the illustrated embodiment; however, the shoulder 30 can be configured by individual engagement hooks that are arranged at a distance from one another and distributed over a circumference of the sleeve 28. This annular shoulder 30 is used for clip fixating the actuation member 12, wherein the annular shoulder 30 in inserted position reaches in a spring elastic manner behind a respective recess 32 of the slider element 12. Also the container 24 is advantageously interlocked at the dispenser housing 2 and fixated and supported through snap locking.

Any suitable pump that is used for standard dosing dispensers can be used a pump unit. In particular however pump units are suitable that are described in principle and in utility models DE 20 2010 011 248 U1 or DE 20 2010 009 751 U1.

In the illustrated embodiment the pump unit 22 that is advantageously configured as pressure suction pump includes a pump cylinder 34 adjacent to the face wall 26 wherein the pump cylinder 34 is received within the sleeve 28 by a circumferential bead 36 which is advantageously integrally configured with the pump cylinder 34. Above the pump cylinder 34 there is a pump piston 38 which is in a starting position in the illustration according to FIGS. 3 and 4 and thus partially penetrates on top into the pump cylinder 34. The pump piston 38 is arranged in a pump housing 40 which envelops the pump piston 38 concentrically and at a distance and which forms a receiving cavity for a spring 44 that is configured as a spiral or compression spring which extends over the pump piston 38 into the ring cavity between the bead 36 and the pump cylinder 34.

Below the pump cylinder 34 there is an annular jacket 45 which is arranged on the face wall 26. The annular jacket 45 includes a center closing opening for a pass through into the pump cylinder 34 of the component pressed out of the container 24. This annular jacket 45 acts as a valve and is formed from a flexible material, in particular a rubber elastic material which opens the closing opening under a vacuum. Above the pump piston 38 the pump housing 40 continues in upward direction towards the applicator 4 and forms a receiving cavity for a valve member 46 which is preloaded by a spring 47 in downward direction towards the pump piston 38 which is provided with a flow through channel and whose upper end is blocked by the valve member 46.

Above the pump unit 22 there is the applicator 4 with a pass through channel 50 which is flow connected with the pump unit and the container 24. The applicator 4 which can be configured in a suitable manner in any way depending on the application is inserted and supported in a known manner through an insertion and/or interlocking connection into an open top sleeve 52 of the dispenser housing 2.

Optionally the container 24 that is open at a bottom as illustrated in FIGS. 3 and 4 can be closed by a piston 54 of any construction which is inserted into the open bottom container 24 after filling in the component to be put out.

Optionally an insertion cover 56 is snap locked in or inserted at a lower face end of the dispenser housing 2.

The piston 54 is suitably configured and seals the container 24 in downward direction. A piston configured according to DE 20 2010 011 248 U1 is particularly suitable in which a sealing film made from the material filled into the container 24 is formed in an annular gap between the piston 54 and an inner wall of the dispenser housing 24 with the first pump strokes which provides an excellent seal in an simple manner.

Furthermore FIG. 3 also illustrates the actuation member configured as a slider element 12 and a grip recess 20 configured on an opposite side in the dispenser housing 2.

The dosing dispenser according to FIGS. 1-4 operates as follows.

It is thus presumed that dosing processes have already been performed so that the material to be put out is already arranged in the pump cavity defined by the pump cylinder 34. When the slider element 12 is moved upward again manually the slider element takes the container 24 along for a translatoric movement since the container is coupled there with and interlocked by the recess 32 and the annular shoulder 30 so that the container 24 is moved along the longitudinal axis 16 of the dispenser housing according to FIG. 3 in upward direction towards the pump unit 22. Due to this translatoric movement of the container 24 within and relative to the dosing dispenser housing 2, the pump cylinder 34 is moved upward relative to the pump piston 38 that is fixated in the dispenser. In this manner, the pump piston 38 moves into the pump cylinder 34 due to this relative linear movement and thus a volume of the pump cavity defined by the pump cylinder is reduced with the consequence that the valve element 46 lifts off from the pump piston due to the pressure created and the pre load spring 48 which loads the valve member 46 is compressed. Thus the material disposed in the pump cavity is put out towards the applicator. When the slider element 12 is released thereafter the pump cylinder 34 is pressed downward by the compression spring 44 in viewing direction of FIG. 3 and thus also the container 24 and through the annular step 30 also the slider element 12 which increases the volume of the pump cavity 58 again which is defined by the pump cylinder 34 so that a vacuum is created which lifts the valve which is configured as a jacket in the center and thus opens it so that the component is suctioned from the container 24 into the pump cavity 58.

In the illustrated embodiment this has the consequence that due to the reduction of the volume of the component within the container 24 also the piston 54 is pulled upward accordingly or readjusted due to an adhesion at the surface of the component arranged in the container 24 simultaneously with a material dispensing into the pump cavity 58.

When the slider element 12 is pressed upward again the pump cavity 58 is reduced since the pump cylinder 34 is moved upward relative to the pump piston 38 and then the valve element 46 opens due to the pressure built up in the pump cavity 58 so that the component arranged in the pump cavity 58 is pressed in upward direction through the flow through channel 50 towards the outlet opening 6 of the applicator. Dosing material is thus possible until the piston 54 has moved in upward direction towards the face wall due to emptying the container 24.

This way a respective dosing of the component included in the container 24 can be performed in upward direction through the outlet opening 6 of the applicator 4.

As already stated supra using the illustrated slider element is optional which will be illustrated in more detail infra with reference to FIGS. 5-10.

Figure 6:
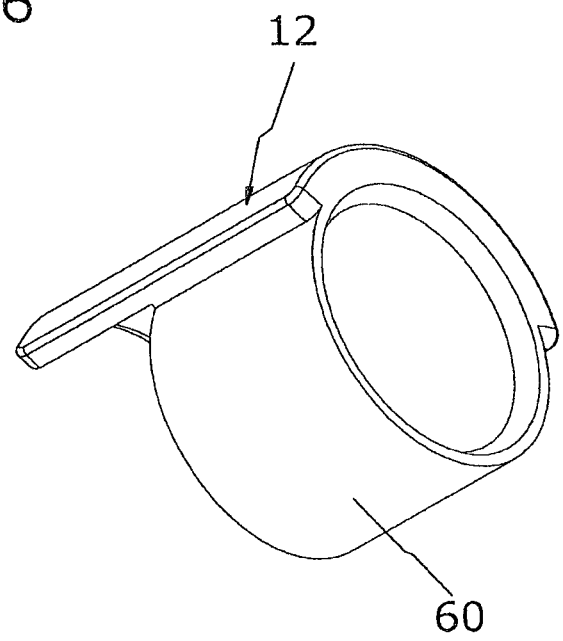
FIG. 6 illustrates a perspective view of the slider element from another direction.
Figure 5:
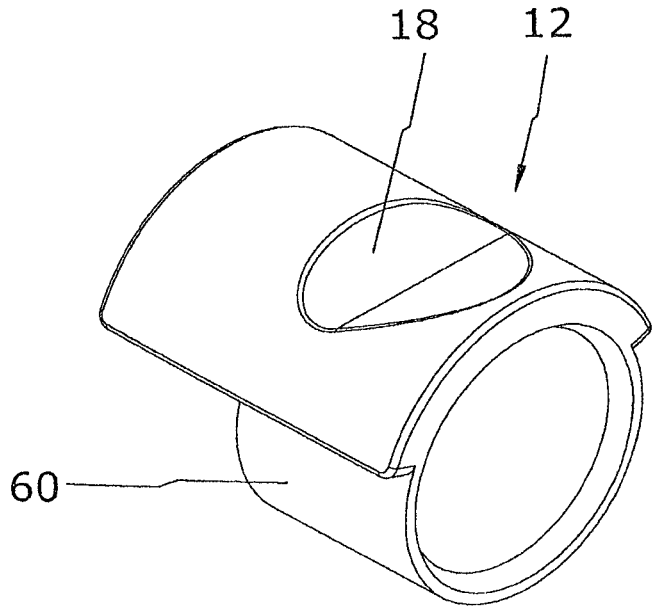
FIG. 5 illustrates a perspective view of a dosing dispenser as it can be used in the dosing dispenser according to FIGS. 1-4 and thus in particular configured as a slider element.

FIGS. 5 and 6 illustrate the slider element 12 with the grip recess 18 and an annular sleeve 60 integrally formed at the slider element 12. The sleeve which is in particular circular cylindrical according to FIGS. 5 and 6 however does not need to be closed all around it can include a divider gap that extends over a length of the sleeve so that the sleeve 60 can then be clipped fastened onto the sleeve 28 of the container from a side.

Figure 7:
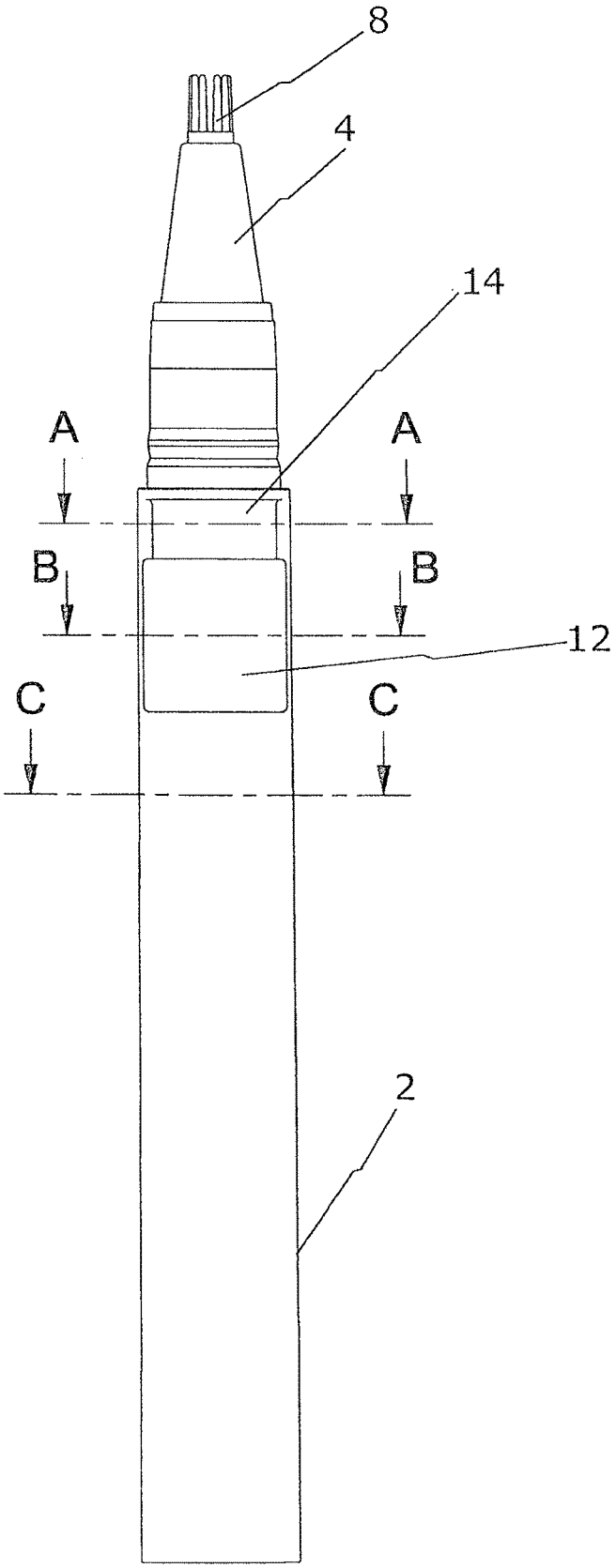
FIG. 7 illustrates an exterior view of the dosing dispenser according to FIGS. 1-4 and thus in analogy to the illustration in FIG. 1 for illustrating various sectional views which are illustrated in the subsequent figures.

FIG. 7 illustrates an elongated opening 14 for receiving the slider element 12 and it is evident that the opening 14 includes sufficient clearance for the sliding movement of the slider element 12 along the housing axis 16. As evident from FIG. 2 the slider element does not protrude in outward direction beyond the dispenser housing 2 but it is flush therewith. Optionally however it is also possible to let the slider 12 protrude slightly outward, approximately 6 or up to 7 mm, in particular up to 3 or 4 mm in order to facilitate griping the slider 12. Advantageously the wall of the slider, in particular its outer surface is adapted to the outer contour of the housing 2 thus advantageously configured convex wherein the sleeve 60 adjoins to the outer contour of the housing.

Figure 8:
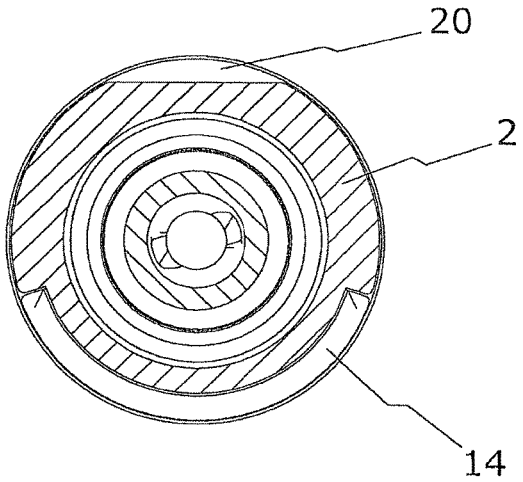
FIG. 8 illustrates a sectional view of the dosing dispenser according to FIG. 7 along the line A-A in an enlarged representation.
Figure 9:
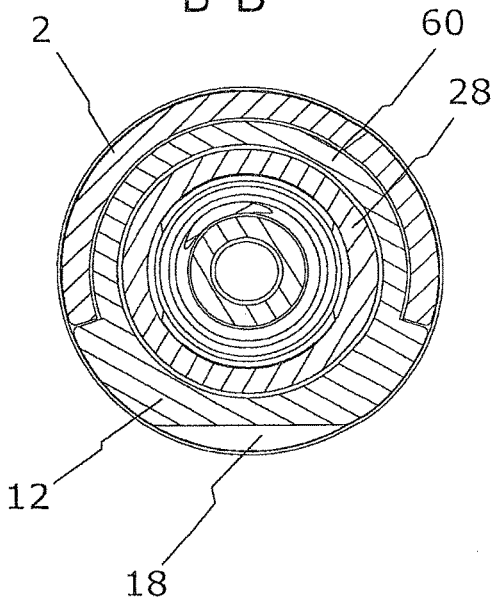
FIG. 9 illustrates another sectional view of the dosing dispenser according to FIG. 7 along the line B-B also in an enlarged representation.
Figure 10:
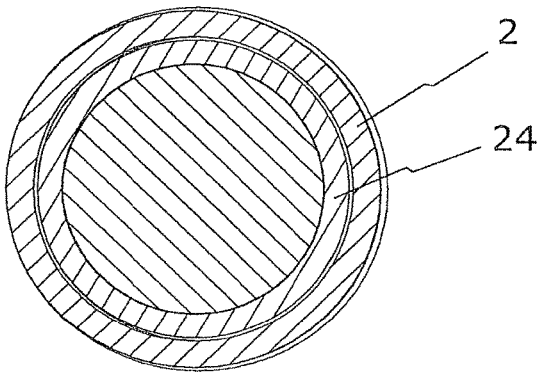
FIG. 10 illustrates a sectional view along the line C-C in FIG. 7 (enlarged illustration)

The sectional view of FIG. 8 illustrates the recess 14 and the dispenser housing 2 with the handle recess 20. FIG. 9 which illustrates a sectional view through the slider element 12 illustrates the slider element 12 with the sleeve 60 enveloping the housing 28 of the container 24 which prevents that the slider element 12 can fall out of the opening 14. Thus the slider element 12 is anchored at the upward protruding sleeve of the container 24 through the sleeve 60. FIG. 10 eventually illustrates the dispenser housing 2 which envelops the container 24 into which the component if filled that is to be put out.

Figure 11:
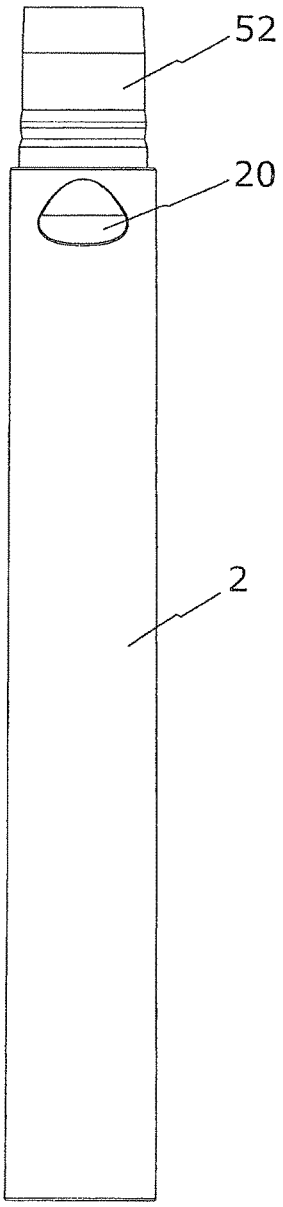
FIG. 11 illustrates an outside view of the dosing dispenser housing.
Figure 12:
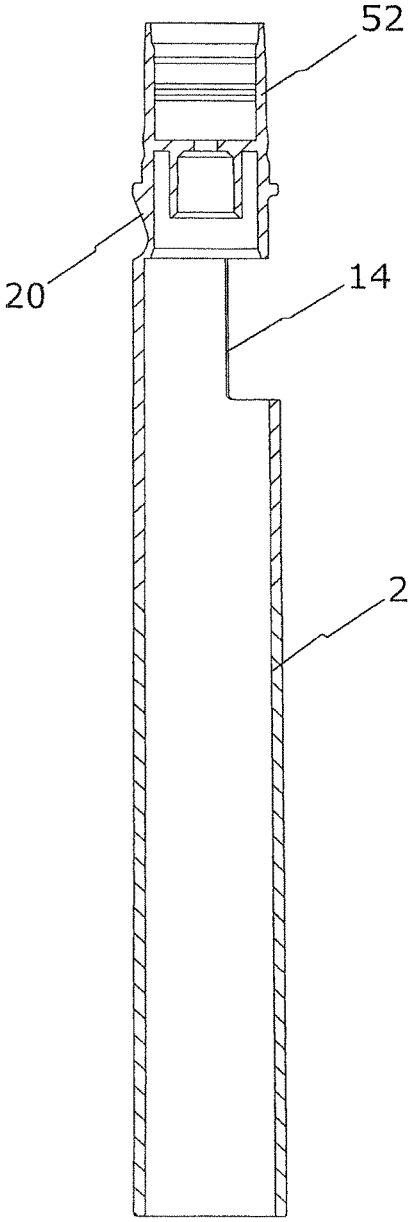
FIG. 12 illustrates a sectional view of the housing of the dosing dispenser in a position that is rotated by 90° relative to FIG. 11.
Figure 13:
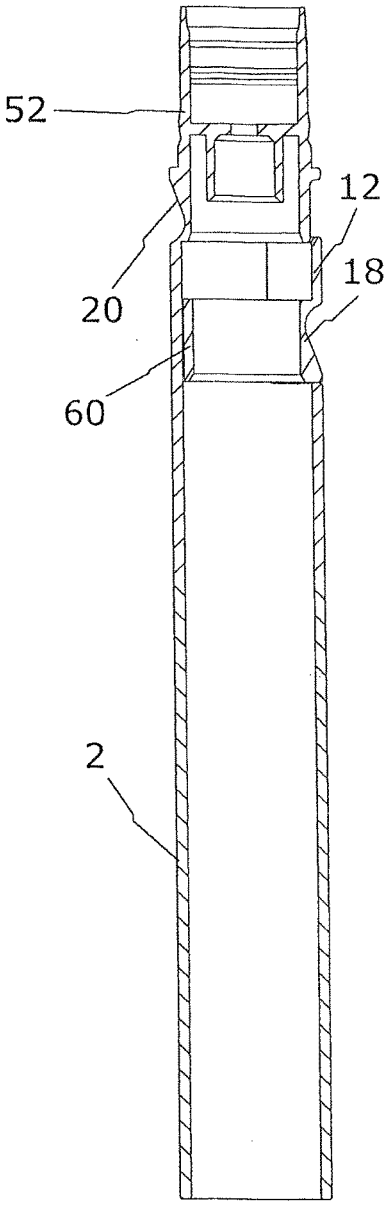
FIG. 13 illustrates a sectional view of the dispenser housing in analogy to FIG. 12, however with the slider element inserted.

FIGS. 11-13 finally illustrate the dispenser housing 2 with the upper sleeve 52 which is advantageously integrally formed thereon in one piece for receiving the applicator, the additional handle opening 20 advantageously provided in the dispenser housing 2 and the opening 14 for receiving the slider element illustrated in FIG. 12. FIG. 13 eventually illustrates the slider element 12 inserted into the opening 14.

As stated supra using the slider element as an actuation member only represents an advantageous variant so that suitable variations or changes of the actuation member are easily implementable. For example instead of a translatorically moveable slider element also a roller supported in the dispenser housing or similar with ribs distributed the circumference or similar or a rubber coated or friction generating or ribbed surface can be provided at a portion of the container 24 that is aligned with the opening 14 and moveably supported in the dispenser housing 2 so that the container 24 can be pressed in upward direction against the pump unit 22. In order to increase the friction locking engagement of this variant (which is not illustrated in the drawing a rib configuration can be provided at the contact surface of the container wherein the roller or the finger directly impacts the rib configuration, a roughened area or a rubber coating or a coating with increased friction so that an undisturbed translatoric sliding movement of the container 24 is provided.

Thus, it is also possible to use the container 24 so to speak directly as an actuation member in that the portion of the container 24 or of the sleeve 28 that is arranged opposite to the opening 14 is provided with a roughened area, a rib configuration, a rubber coated or otherwise friction increased surface or coating. Through a finger movement of the opening 14 the container 24 can be pressed directly upward manually against the pump unit. This is also within the scope and spirit of the invention.

An advantage of these dosing containers is there slender and compact configuration which furthermore facilitates to make the actuation member substantially flush with an outer surface of the dispenser housing which is very advantageous for an optical design of the dosing dispenser. Additionally the translatoric movement of the container through the actuation member facilitates a movement of the container 24 against the pump unit 22 for the purpose of dosing directly and manually through an access to the container wherein in hand transfer is required for applying the output component with the applicator rather the output component is applied and distributed to the skin or a surface to be glued easily with the same handle.

Figure 14:
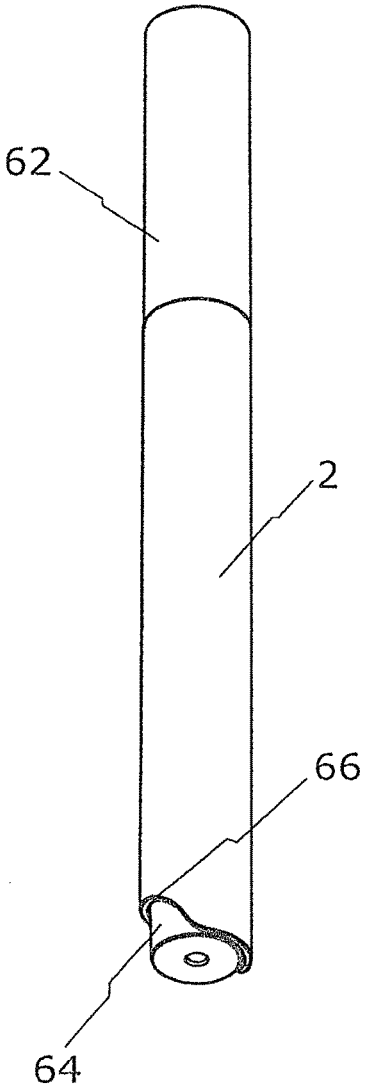
FIG. 14 illustrates an exterior view of another embodiment of the invention which can be optionally coupled with the embodiment illustrated in FIGS. 1-13 in order to facilitate double handling.

FIG. 14 illustrates another embodiment of the invention, thus of a one component dosing dispenser wherein the general configuration with respect to applicator, pump unit and container and dispenser housing substantially corresponds to the general configuration of the previously described embodiment so that only particular component are described infra in order to avoid repetitions.

Figure 15:
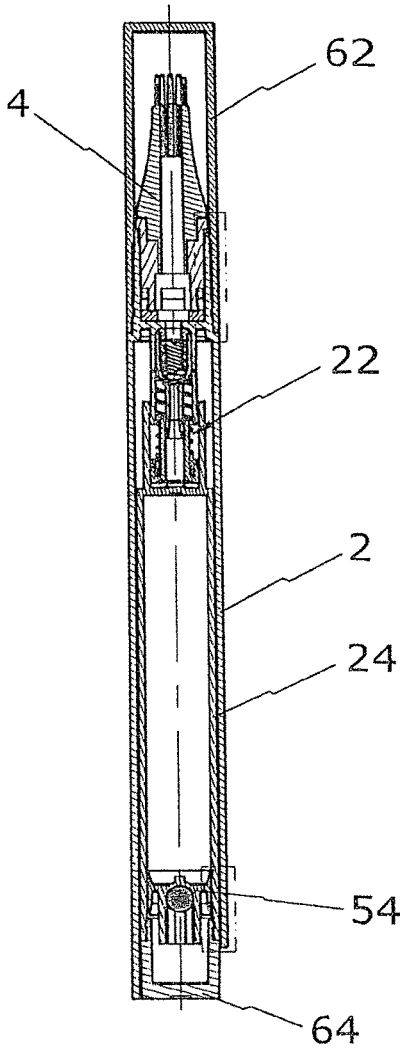
FIG. 15 illustrates a sectional view through the dosing dispenser according to FIG. 14.

According to FIG. 14 a cover 62 is placed on the dispenser housing 2 wherein the cover covers the applicator according to FIG. 15. A cover of this type can certainly also be used in the embodiment described supra.

FIG. 14 illustrates a push button 64 which is placed onto the container 24 within the dispenser housing 2 on a side that is oriented away from the applicator 4 and through which the container 24 can be pressed upward in a direction towards the pump unit 22 which is configured according to the embodiment described supra in order to cause the activation of the pump unit 22 and thus to move material from the container 24 out of the applicator 4. Furthermore the function is the same as in the embodiment described supra. The embodiment illustrated in FIGS. 14 and 15 can be used independently from the embodiment according to FIGS. 1-13 but it can also be coupled with this embodiment thus it can also be provided with a slider element or similar in an upper third of the dispenser housing, so that a dual actuation for dosed dispensing is possible, namely through the actuation member arranged in the upper third of the dispenser, like e.g. the slider element or on the other hand side by the push button 64.

As evident from FIG. 14 the dispenser housing 2 has a recess in the portion of the push button in order to facilitate easy manual depressing of the push button 64. FIG. 14 clearly shows the slender and optically appealing embodiment of the dosing dispenser.

The invention claimed is:

1. A dosing dispenser for putting out pasty or viscous material, comprising:

a container including the material which container is received in a dispenser housing;

a pump unit arranged in front of the container; and an applicator applied at the pump unit for dosed material output, wherein the dispenser housing includes an actuation member which facilitates moving the container that is moveably arranged in the dispenser housing relative to the pump unit, so that the pump unit is activatable by the container for suctioning and dispensing the material, wherein the actuation member is formed by an opening in the dispenser housing which facilitates a manual access to the container supported in the dispenser housing in order to move the container in a linear manner or the actuation member is configured as a slider element that is inserted into an opening of the dispenser housing, wherein the slider element includes an annular sleeve which reaches around a sleeve of the container arranged in the pump unit for coupling the container to the slider element, and wherein the slider element is translatorically moveable in the opening so that the container is moveable back and forth caused by the sliding movement of the slider element in order to activate the pump unit.

2. The dispenser according to claim 1, wherein the container is moveable back and forth translatorically along the longitudinal axis of the dispenser housing relative to the pump unit and supported by the dispenser housing.

3. The dispenser according to claim 1, wherein the opening is configured in the housing in a forward third proximal to a portion of the pump unit.

4. The dispenser according to claim 1, wherein the slider element is coupled with the container by a shoulder formed on the container sleeve which interlocks with a recess of the slider element.

5. The dispenser according to claim 4, wherein the slider element includes a handle recess, wherein a grip recess is advantageously provided on a side of the dispenser housing that is arranged opposite to the slider element, wherein the grip recess is arranged slightly higher relative to the handle recess in the slider element with reference to the pump unit.

6. The dispenser according to claim 1, wherein the slider element is substantially flush with the outer surface of the dispenser housing.

7. The dispenser according to claim 1, wherein an outer surface of the slider element is cambered to the circumferential contour of the dispenser housing.

8. The dispenser according to claim 1, wherein the container includes a face wall provided with at least one opening at an end portion of the container oriented towards the pump unit, wherein the sleeve of the container extends from the face wall, wherein the container sleeve receives a pump cylinder of the pump unit which interacts with a pump piston provided with a material pass through with a spring connected there between and which advantageously includes a valve member closing the material pass through of the pump piston, wherein the valve member is preloaded in the closing position by a spring against the pump piston.

9. The dispenser according to claim 8, wherein moving the container in a direction towards the pump unit moves the pump cylinder relative to the pump piston, wherein the pump piston penetrates the pump cylinder thus reducing a size of a pump cavity defined by the pump cylinder, and wherein the pump cylinder is moved back into its starting position by the spring after disengaging the slider element so that the container is moved back into its starting position.

10. The dispenser according to claim 8, wherein a seal jacket advantageously made from a flexible material is arranged between the pump cylinder and the face wall of the container so that the seal jacket is provided with at least one closing opening which opens under vacuum and facilitates dispensing the material from the container.

11. The dispenser according to claim 1, wherein the container is closed by a piston at an end arranged opposite to the pump unit, wherein the piston is moveable within the container and advantageously seals the container at this end.

12. The dispenser according to claim 11, wherein the end of the container receiving the piston is closed by a cover or by a push button, wherein the container is moveable by the push button in a translatoric manner towards the pump unit for activating the pump unit and the container is preloaded into its starting position by a spring.

13. The dispenser according to claim 1, wherein attachment of the individual components of the dispenser is respectively provided by an interlocking, clip or plug in connection.

* * * * *